US006086401A

United States Patent [19]

Hsiung et al.

[11] Patent Number: 6,086,401

[45] Date of Patent: Jul. 11, 2000

[54] TERMINAL HAVING LOW INSERTION FORCE

[75] Inventors: Bill C. Hsiung, Fremont, Calif.; Nick Lin, Hsin-Chuang; Pei-Rong Wang, Tu-Chen, both of Taiwan

[73] Assignee: Hon Hai Precision Ind. Co., Ltd., Taipei Hsien, Taiwan

[21] Appl. No.: 09/127,444

[22] Filed: Jul. 31, 1998

[30] Foreign Application Priority Data

Oct. 27, 1997 [TW] Taiwan ..... 83208396 A01

[51] Int. Cl.[7] ..... H01R 4/50

[52] U.S. Cl. ..... 439/342; 439/862; 439/259

[58] Field of Search ..... 439/342, 259, 439/862

[56] References Cited

U.S. PATENT DOCUMENTS

| | | | |
|---|---|---|---|
| 5,443,591 | 8/1995 | Tsai | 439/342 |
| 5,454,727 | 10/1995 | Hsu | 439/342 |
| 5,489,218 | 2/1996 | McHugh | 439/342 |

*Primary Examiner*—Paula Bradley
*Assistant Examiner*—Tho D. Ta

[57] ABSTRACT

A terminal comprises a terminal body and a leg extending downward from a first edge of the terminal body. An elastic arm extends upward from a second edge opposite to the first end, and a grasping plate is integrally formed at an end of the elastic arm. The grasping plate includes a curved surface for receiving a mating terminal with a low insertion force. The elastic arm has a section of reduced dimension to facilitate deformation of the grasping plate when contacting a mating terminal.

6 Claims, 3 Drawing Sheets

TERMINAL HAVING LOW INSERTION FORCE

FIELD OF THE INVENTION

The present invention relates to a terminal, and more particularly to a terminal adapted for receiving a mating terminal with low insertion force.

DESCRIPTION OF PRIOR ART

Taiwan Utility Model Application No: 83208396 discloses a terminal for use with a socket for mounting a central processing unit (CPU) thereon. The terminal comprises a terminal body, a leg extending downward from a first edge of the terminal body, an elastic arm extending upward from a second edge opposite to the first edge, and a grasping plate integrally formed at an end of the elastic arm. The grasping plate includes a curved surface for receiving a mating terminal with a low insertion force. However, a cross sectional dimension of the elastic arm is too large thereby preventing the elastic arm from easily deforming to receive the mating terminal when the grasping plate contacts therewith. Accordingly, the mating force between the grasping plate and the mating terminal is not suitable for use with the socket.

SUMMARY OF THE INVENTION

An objective of this invention is to provide a terminal having an elastic arm with reduced dimension to facilitate deformation of a grasping plate to receive a mating terminal while still ensuring an effective electrical contact therebetween when a final mating position is attained.

In order to achieve the objective set forth, a terminal in accordance with the present invention comprises a terminal body and a leg extending downward from a first edge of the terminal body. An elastic arm extends upward from a second edge opposite to the first edge, and a grasping plate is integrally formed at an end of the elastic arm. The grasping plate includes a curved surface for receiving a mating terminal with a low insertion force. The elastic arm has an extension with a reduced dimension to facilitate deformation of the grasping plate when a mating terminal is contacted.

These and additional objects, features, and advantages of the present invention will become apparent after reading the following detailed description of the preferred embodiment of the invention taken in conjunction with the appended drawings.

DETAILED DESCRIPTION OF PREFERRED EMBODIMENT

Figure 1:
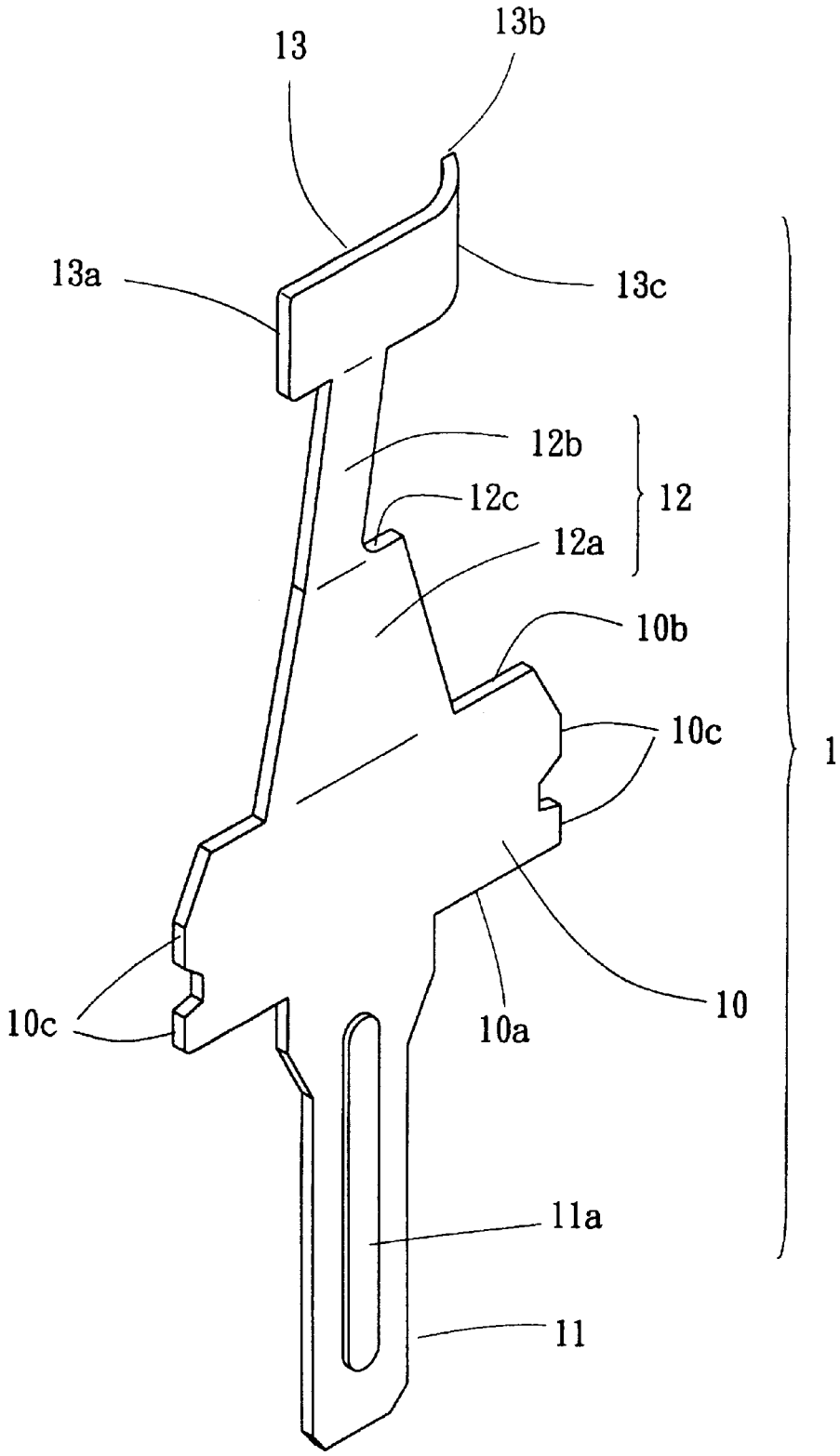
FIG. 1 is a perspective view of a terminal in accordance with the present invention.
Figure 2:
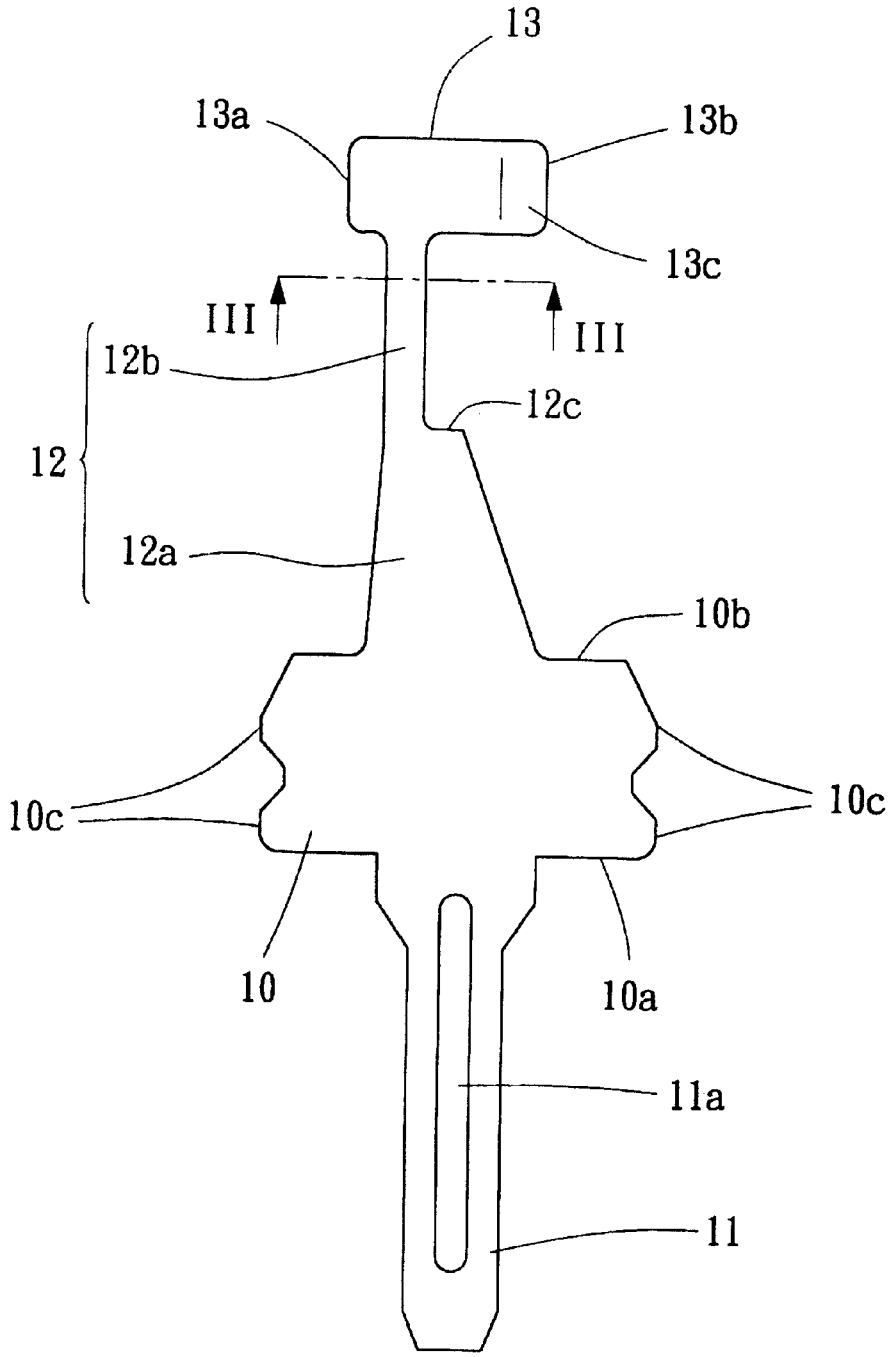
FIG. 2 is a front plan view of the terminal of FIG. 1.

Referring to FIGS. 1 and 2, a terminal 1 having a lower contacting force generally has a planar configuration. The terminal 1 comprises a terminal body 10 and a leg 11 extending downward from an edge 10*a* of the terminal body 10. The terminal body 10 forms barbs 10*c* at transverse sides thereof which interferentially engage with a terminal passage of a housing (not shown). The leg 11 is adapted to be inserted into a mounting hole of a printed circuit board (not shown). The leg 11 forms a reinforced rib 11*a* thereon to increase the overall rigidity thereof.

An elastic arm 12 extends upward from an opposite edge 10*b* of the body 10. The elastic arm 12 generally includes an arm base 12*a* and an extension 12*b*. The arm base 12*a* has a trapezoidal shape and the extension 12*b* extends from a narrow side thereof. A step 12*c* is formed between the base 12*a* and the extension 12*b*.

A grasping plate 13 is integrally formed at an end of the extension 12*b*. The grasping plate 13 defines a first end 13*a*, a second end 13*b*, and a curved surface 13*c* formed adjacent to the second end 13*b*.

Figure 4:
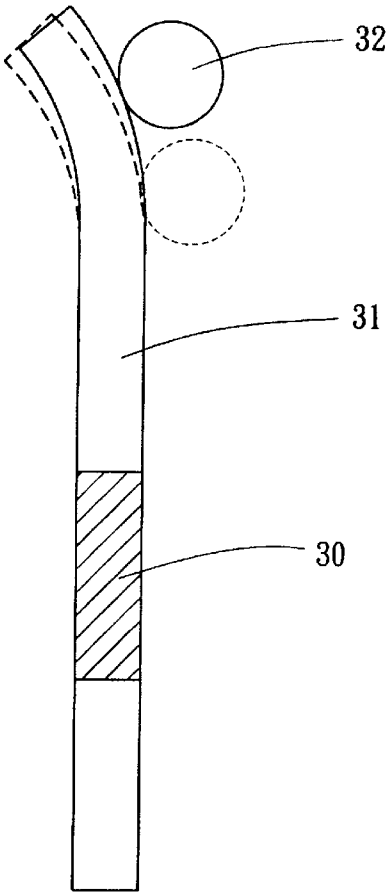
FIG. 4 (PRIOR ART)
FIG. 4 is a cross sectional view of the extension of the elastic arm of the terminal disclosed in the '396 application.
Figure 3:
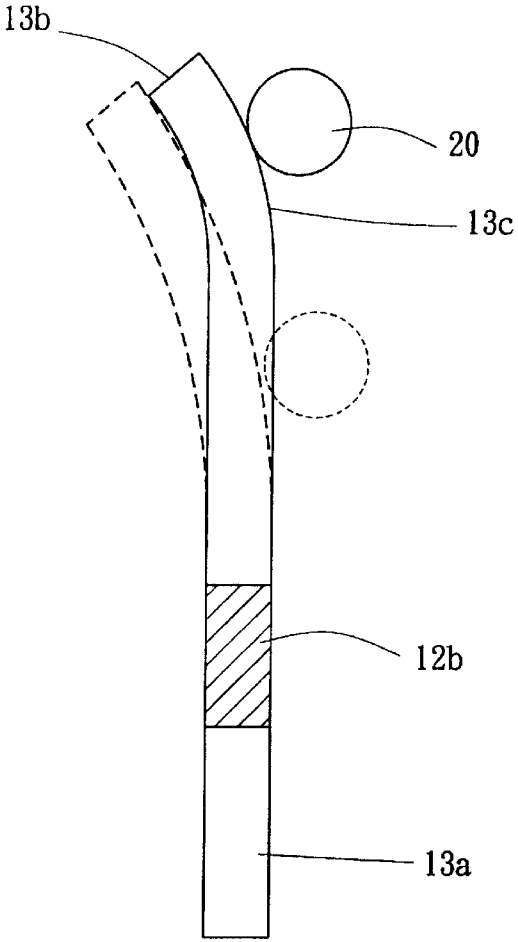
FIG. 3 is a cross sectional view of an extension of an elastic arm taken from line III—III of FIG. 2.

Referring to FIGS. 3 and 4, when a mating pin 20 contacts the grasping plate 13 from the curved surface 13*c*, either the grasping plate 13 or the extension 12*b* will twist depending on the rigidity of the two elements. For example, if the rigidity of the extension 12*b* is larger than the plate 13, then the plate 13 will deform. However, this is not suitable for receiving the mating pin 20. Likewise, if the rigidity of the plate 13 is larger than that of the extension 12*b*, then the extension 12*b* will twist when the mating pin 20 contacts therewith. This is more acceptable as the reaction force resulting from the inserted mating pin 20 is uniformly distributed over the entire extension 12*b* by its torsional deformation.

It can be readily seen from FIGS. 2 and 3 that the width of plate 13 is larger than the extension 12*b*, thus the extension 12*b* easily twists to receive the mating pin 20. From another viewpoint, the Young's modulus of the extension 12*b* is smaller than that of the plate 13, the extension 12*b* twists easily.

As shown in FIG. 4, the extension 30 is too large to twist, so the grasping plate 31 must deform accordingly to receive the mating pin 32. As a result, insertion of the mating pin 32 into the conventional terminal is more difficult.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims. Therefore, persons of ordinary skill in this field are to understand that all such equivalent structures are to be included within the scope of the following claims.

We claim:

1. A terminal, comprising:

a terminal body;

a leg extending downward from a first edge of said terminal body;

a single elastic arm including an arm said arm base extending upward from a second edge opposite to the first edge for engaging with a mating terminal, an extension with a first width extending from said arm base, a step formed between said arm base of said elastic arm and said extension; and a grasping plate integrally formed at an end of said extension, said grasping plate having a second width which is larger than said first width.

2. A terminal as recited in claim 1, wherein said grasping plate includes a curve surface extending from an end distanced from said extension.

3. A terminal recited in claim 1, wherein said arm base has a trapezoidal shape.

4. A terminal as recited in claim 1, wherein said extension has an elongate shape.

5. A terminal as recited in claim 1, wherein the first width of said extension is smaller than a narrow side of said arm base.

6. A terminal as recited in claim 1, wherein said extension has lower Young's modulus than that of said grasping plate.

* * * * *